US006761158B2

(12) United States Patent
Wright

(10) Patent No.: US 6,761,158 B2
(45) Date of Patent: Jul. 13, 2004

(54) STRING AND CABLE SILENCERS FOR ARCHERY BOWS

(76) Inventor: Stuart D. Wright, 18500 Rimrock Rd., Hayden, ID (US) 83835

( * ) Notice: Subject to any disclaimer, the term of this patent is extended or adjusted under 35 U.S.C. 154(b) by 0 days.

(21) Appl. No.: 10/115,809

(22) Filed: Apr. 2, 2002

(65) Prior Publication Data

US 2003/0183219 A1 Oct. 2, 2003

(51) Int. Cl.[7] ..... F41B 5/20
(52) U.S. Cl. ..... 124/92
(58) Field of Search ..... 124/90, 92, 91; 446/126

(56) References Cited

U.S. PATENT DOCUMENTS 3,059,629 A * 10/1962 Stinson
3,584,615 A * 6/1971 Stinson
3,612,029 A * 10/1971 Carroll et al.
3,648,404 A * 3/1972 Ogsbury et al.
3,756,214 A * 9/1973 Christen
4,080,951 A * 3/1978 Bateman ..... 124/92
5,016,604 A * 5/1991 Tilby ..... 124/92
5,287,842 A * 2/1994 Saunders ..... 124/91
5,979,427 A * 11/1999 Chalin et al.
RE36,555 E * 2/2000 Tentler ..... 124/91
6,237,584 B1 * 5/2001 Sims ..... 124/92
6,264,522 B1 * 7/2001 Dickson
6,446,620 B1 * 9/2002 Summers et al. ..... 124/92

* cited by examiner

*Primary Examiner*—John A. Ricci

(57) ABSTRACT

String and cable silencers for reducing the sound generated when an arrow is released from a conventional archery bow or compound archery bow. The silencers are made from a soft rubber type material that absorbs and dampens the vibrations when the bowstring or cables begin to vibrate. Disclosed silencers will fit any conventional strings or cables as well as split bow strings and split cables, since they fit around the outside diameter of the bow strings or cables. The string and cable silencers can be fastened to the stings or cables by tying on with string or by using small zip ties placed over the ends of the string and cable silencers. The string and cable silencers have a central hub with four equal arms that extend out perpendicular to the string or cable with round balls molded on the ends of the arms.

2 Claims, 6 Drawing Sheets

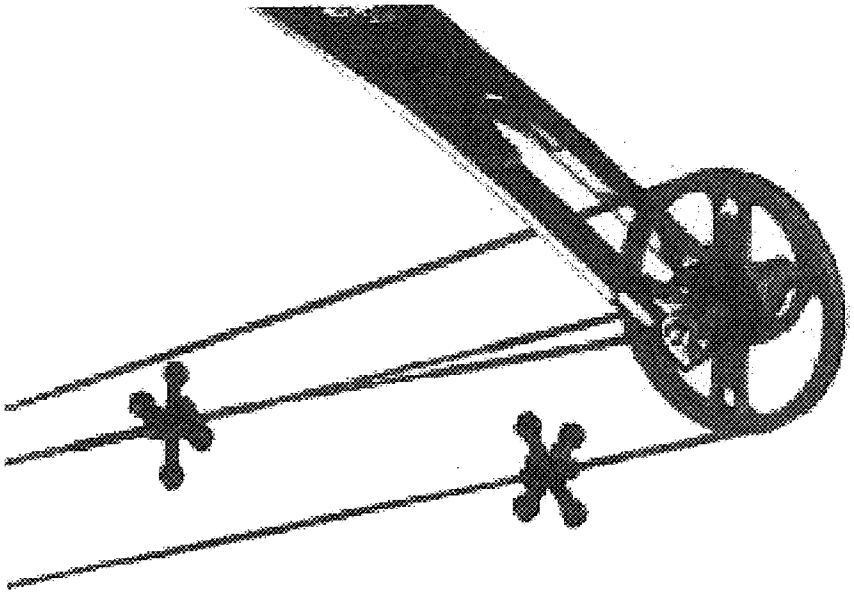
FIG. 1)

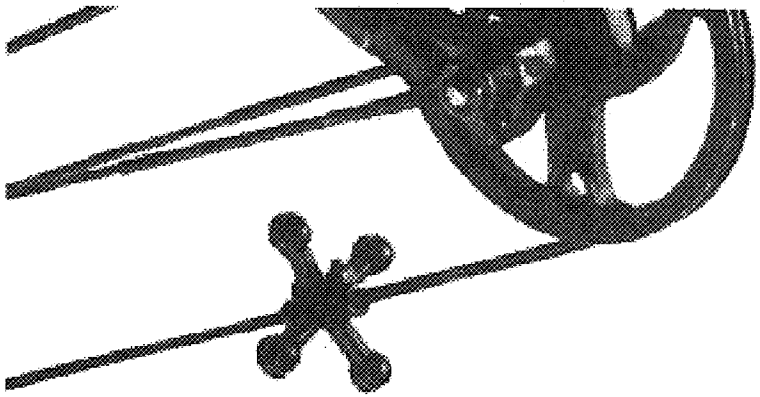
FIG. 2)

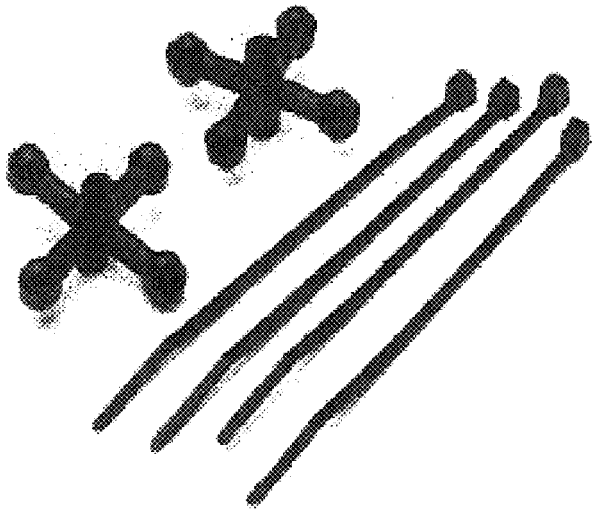
*FIG. 3)*

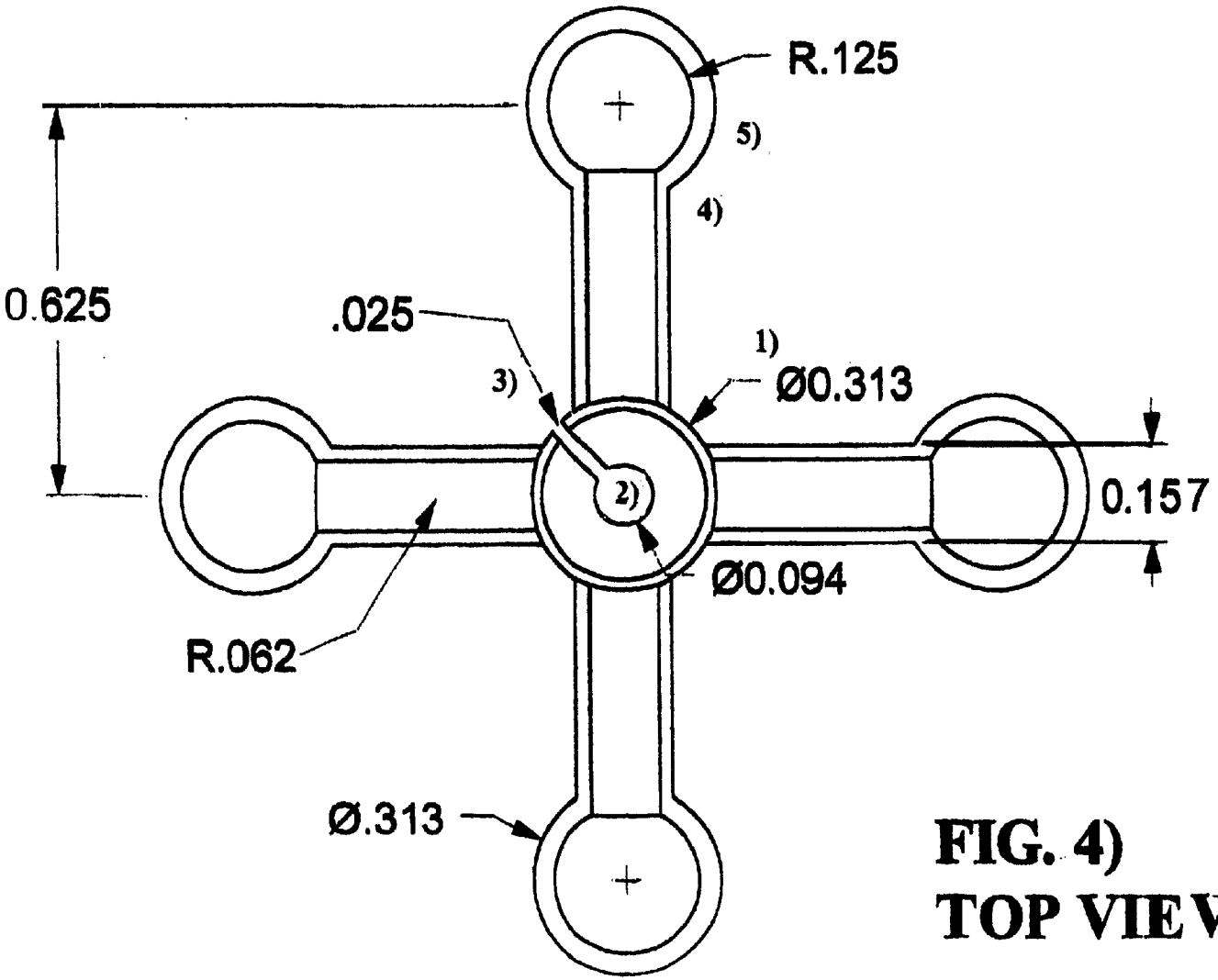
FIG. 4)
TOP VIEW

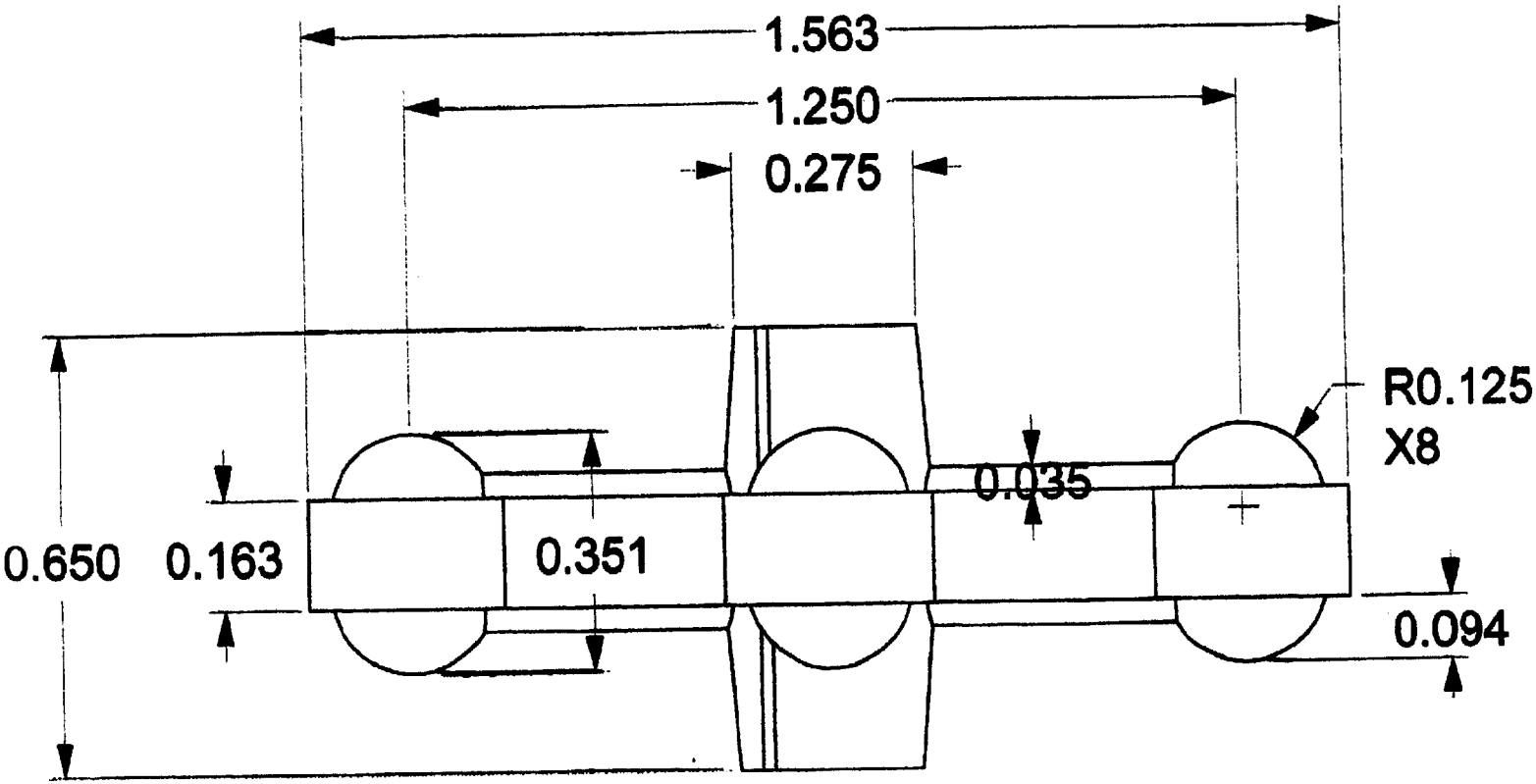
FIG. 5)
FRONT VIEW

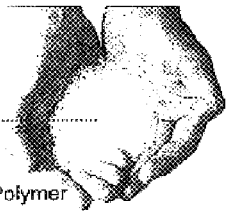

Technical Data Sheet

DYNAFLEX® G7930-1001-00

Thermoplastic Elastomer Compound made with KRATON® Polymer

The DYNAFLEX® G7930-1001-00 Thermoplastic Elastomer Compound is an easy processing, general purpose material designed for a wide variety of applications, including those where FDA compliance is required.

| *Product Feature* | *Example Applications:* |
|---|---|
| SOFT TOUCH, RUBBERY FEEL, NON-SLIP GRIP | HARDWARE AND POWER TOOL GRIPS |
| OVERMOLD ADHESION TO POLYPROPYLENE | DISPOSABLE GRIPS AND HANDLES |
| NSF-51 (FOOD CONTACT/EQUIPMENT) | SPORT GRIPS AND KNOBS |
| GOOD OZONE/UV STABILITY | HAND HELD ELECTRONICS |
| AUTOMOTIVE FMVSS 302 | HOUSEWARE UTENSILS AND APPLIANCES |

| Color | Natural |
|---|---|

| Physical Data | | English | Metric |
|---|---|---|---|
| **Hardness** | | | |
| Shore A- 10 sec dwell | ASTM D2240 | 30 Shore A | |
| **Specific Gravity** | | | |
| | ASTM D792 | 1.06 | |
| **Melt Flow Rate** | | | |
| 190°C / 2160g | ASTM D1238 | 0.5 g/10 min | |
| 200°C / 5000g | | 30 g/10 min | |
| **Viscosity @ 200°C** | | | |
| at 1117/sec | ASTM D1238E | 6400 cPs | 6 Pa-sec |
| **Shrinkage** | | | |
| Flow Direction | ASTM D955 | 0.017 - 0.021 in/in | 0.017 - 0.02 mm/mm |
| **Compression Set @ 23°C** | | | |
| | ASTM D395B | 13 % | |

| Tensile Data | | English | Metric |
|---|---|---|---|
| **Cross Direction** | | | |
| @ 100 % | ASTM D412 - Die C | 110 PSI | 758 kPa |
| @ 300 % | | 230 PSI | 1585 kPa |
| Elongation | | 770 % | 770 % |
| Tear | ASTM D624 - Die C | 100 PLI | 17 kN/m |
| Tensile | ASTM D412 - Die C | 700 PSI | 4825 kPa |
| **Flow Direction** | | | |
| @ 100 % | ASTM D412 - Die C | 130 PSI | 896 kPa |
| @ 300 % | | 260 PSI | 1792 kPa |
| Elongation | | 650 % | 650 % |
| Tear | ASTM D624 - Die C | 100 PLI | 17 kN/m |
| Tensile | ASTM D412 - Die C | 490 PSI | 3378 kPa |

KRATON® is a registered Trademark of KRATON Polymers U.S. LLC.

DYNAFLEX® is a trademark of GLS Corporation.

Figure 6)

STRING AND CABLE SILENCERS FOR ARCHERY BOWS

THE FIELD OF THE INVENTION

The present invention is to improve upon previous devices for reducing the sound generated upon the release of an arrow from an archery bow, or compound archery bow.

THE BACKGROUND OF THE INVENTION

It is widely known that the archery bow string and to a lesser degree the compound archery bow cables produce a very distinct sound upon the release of the arrow.

This sound is due to the violent harmonic vibrations that take place when the arrow is departing from the string, and to a lesser degree the harmonic vibrations imposed upon the compound cables.

Previous string silencers have been designed to dampen the vibrations of the bowstring, and if possible have probably been used to help silence the compound cables as well.

The other string silencers that are widely available today are;

1) The "puff string silencers", U.S. Pat. No. 4,080,951.
2) The "tarantula string silencers", U.S. Pat. No. 5,016, 604.
3) The "Sims string leech", U.S. Pat. No. 6,237,584.
4) The "cat whisker silencers".

None of the available silencers that are in use today can completely eliminate the string and cable noise, but they can drastically reduce the sound created when the arrow is released from the string. The listed string silencers each have there drawbacks and limitations.

1) The "puff string silencers", U.S. Pat. No. 4,080,951, can absorb water and therefore increase in weight, thus reducing the performance in arrow speed and accuracy. The yarn used in the "puff string silencers" can unravel and become frayed, and under the continued stresses of shooting the bow or crossbow, the tiny strands of yarn could dislodge.
2) The "tarantula string silencers", U.S. Pat. No. 5,016, 604, are constructed of strips of polyester fleece, which although will not absorb water, is a much less effective string silencer than the last two, "Sims string leech" U.S. Pat. No. 6,237,584 and "cat whisker silencers".
3) The "Sims string leech", U.S. Pat. No. 6,237,584, have two arms that run opposite directions, but parallel along the bow string. The "Sims string leech" is constructed from a material called NAVCOM, a rubber like material that is also used by Sims in U.S. Pat. No. 5,362,046. Although the "Sims string leech" is highly effective in reducing the string vibration and the consequent sound, it has been observed as having a relatively short life on modern high performance compound archery bows.
4) The "cat whisker silencer", is a cluster of live rubber strings which are fastened at their center to the bow string by means of a string. They are generally viewed as the best string silencer for reducing noise and vibration, but since the cat whiskers are thin rubber strands they are more susceptible to dry rot, ultraviolet light, and ozone decay. They need to be replaced every year.

There still exists a need for a better archery and crossbow string and cable silencer, that can achieve the objectives of such devices, while avoiding the drawbacks of previously designed string silencers.

SUMMARY OF THE INVENTION

The present invention discussed herein is certainly a new and effective string and cable silencer. It is unlike the previous inventions in that it can easily be attached to both conventional archery bow strings and cables as well as split archery bow strings and cables by the use of common zip ties. It appears to have superior noise and vibration dampening characteristics with a very small reduction in initial arrow velocity commonly associated with other string silencers.

BRIEF DESCRIPTION OF THE DRAWINGS

FIG. 1). TWO JACKS ON A BOW—A view of 2 string and cable silencers on the upper limbs of a bow string and cable.

FIG. 2) ONE JACK ON A BOW—A view of one string and cable silencer on a bow string.

FIG. 3) PAIR OF JACKS—A view of a pair of string and cable silencers plus 4 cable ties included in the packaging to install this silencer to the bow string or cables.

FIG. 4) Drawing of string and cable silencer, from top view

FIG. 5) Drawing of string and cable silencer, from front view

FIG. 6) Dynaflex technical data sheet

DETAILED DESCRIPTION OF THE INVENTION

Referring to FIG. 4, the string silencer includes a central hub 1 having a longitudinal passage 2 to receive a bow string or cable. The hub also includes a longitudinal split 3 providing an opening that allows the string to be inserted laterally into the passage. Four arms 4 are integral with the central hub and extend outward from the hub in the same plane, perpendicular to the longitudinal passage, and at 90 degree intervals. A round ball 5 is molded onto the end of each arm opposite the hub.

The silencer is placed on a string, by pushing the string through the longitudinal split 3. A cable tie may be tightened around the central hub, to secure the silencer in place on the string. Excess cable tie would be cut off with scissors.

After the string and cable silencer has been fastened on the string and/or cables, the arms 4 may resiliently flex up and down, and side to side, to dampen the vibration and noise.

The string and cable silencer is preferably integrally molded of a thermoplastic elastomer with a durometer of 33, such as DYNAFLEX brand, available from the GLS Corporation of McHenry, Ill. FIG. 6 shows characteristics of DYNAFLEX. The silencer could be made from other materials as long as it can withstand the stresses of being on a bow string and is soft enough to absorb vibrations. The durometer could range from 20 to 60.

Preferred Dimensions and Variations of the Silencer

Length of arms: 0.312 inch.

Width of arms: 0.157 inch.

Thickness of arms: 0.163 inch.

Diameter of balls: 0.313 inch.

Inside diameter of longitudinal passage: 0.093 inch.

Overall length: 1.563 inch.

Overall height: 0.650 inch.

Overall weight: 27 grains.

The diameter of the balls molded at the ends of the arms are preferred at a 1:1 ratio to the length of the arms; this ratio can be varied from 2:1 to 1:5.

The ratio of the diameter of the balls to the thickness of the arms can be varied from 2:1 to 5:1.

The balls must be at least 1/16 inch larger in diameter than the width of the arms.

The silencer may be produced using various materials and dimensions without departing from the essential design characteristics; the scope of the invention is defined by the following claims.

I claim:

1. A string and cable silencer, for reducing the sound emanating from a bow string or cable upon release of an arrow, said silencer being made of an elastomeric material that can oscillate in all axes, said silencer having a central hub with a longitudinal passage sized to receive a bow string;

four arms of equal length and cross section mounted to and extending outwardly from the central hub, perpendicular to the longitudinal passage;

each arm having a round ball molded onto its end opposite the central hub;

the central hub having a longitudinal split to allow a bowstring or cable to be inserted laterally into the longitudinal passage.

2. A bowstring silencer having a central hub having a longitudinal passage sized to receive a bowstring; four arms of equal length and cross section, mounted to and extending outwardly from the central hub, perpendicular to the longitudinal passage; each arm having a round ball molded onto its end opposite the central hub; the central hub having a longitudinal split that allows a bowstring to be inserted laterally into the longitudinal passage, and wherein the silencer may be secured to the bowstring by means of cable ties.

* * * * *